United States Patent [19]

George, Jr.

[11] 4,161,021

[45] Jul. 10, 1979

[54] LOW ENERGY DECORATIVE LIGHT BULB DISPLAYS

[76] Inventor: Benjamin B. George, Jr., 12751 Browning, Santa Ana, Calif. 92705

[21] Appl. No.: 828,403

[22] Filed: Aug. 29, 1977

[51] Int. Cl.[2] ..... F21P 1/00

[52] U.S. Cl. ..... 362/252; 362/238; 362/240; 362/806

[58] Field of Search ..... 362/806, 809, 811, 230, 362/231, 249, 238, 239, 252, 240, 236; 313/316

[56] References Cited

U.S. PATENT DOCUMENTS

| | | | |
|---|---|---|---|
| 1,507,367 | 9/1924 | Edelstein | 362/240 |
| 2,146,422 | 2/1939 | Davis | 362/811 |
| 2,228,437 | 1/1941 | Blana | 362/252 |
| 3,662,381 | 5/1972 | Steffens | 362/231 |
| 3,755,663 | 8/1973 | George | 362/249 |
| 3,789,211 | 1/1974 | Krammer | 362/811 |

*Primary Examiner*—Brooks H. Hunt

*Assistant Examiner*—J. L. Barr

[57] ABSTRACT

The flexible wire leads of several unbased miniature lamps are welded or soldered end to end in series to form a lamp string that has one end electrically connected to a rigid center wire extending upwardly from the center foot terminal of a lamp base so that, with the base fitted on a spherical or other rounded transparent bulb, the lamp string connection to the rigid wire will be near the central longitudinal axis at the opposite end of the bulb. With the other end of the lamp string held stationary, the base is twisted within the bulb to expand the lamp string, which is folded in a flat S-shape to fit through the narrow tubular base opening in the bulb, until the lamps are each positioned within the bulb at locations displaced from the central axis and inner concave reflecting surfaces. This insures myriad reflected lamp images that give the visual impression of many more lamps with greater apparent illumination though requiring only a few watts of energy.

7 Claims, 2 Drawing Figures

LOW ENERGY DECORATIVE LIGHT BULB DISPLAYS

BACKGROUND OF THE INVENTION

I. Field of the Invention

This invention relates to decorative lighting displays, and more particularly to those involving larger transparent bulbs used for example in rows, strings for Christmas tree lights, and in chandeliers to produce a highly decorative visual effect.

II. Prior Art

Decorative lighting has become increasingly popular with designers and architects, and with the general public, as a major aesthetic focus for interior and exterior emphasis. For example, the light string tubing described and claimed in this applicant's previous U.S. Pat. No. 3,755,663 has been commercially adapted for chandelier, window hangings, wall displays and other designs that have been widely employed in many modernistic hotel and other types of buildings with startling effect. However, although the aesthetic demand to use this and other types of decorative lighting has become more pressing, the recent serious concerns about energy conservation have tended to raise doubts about the practical usefulness of such displays since lighting restrictions are always first directed against wasteful expenditures of large amounts of electricity just for decoration.

Decorative light fixtures with large glass bulbs, usually spherical, have been particularly popular of late. In most cases, these consisted of the usual incandescent filament sealed within a large evacuated bulb. These bulbs were expensive to produce because thicker, high strength glass was needed to withstand heavier pressure loads over the larger bulb area, or an inert gas filling had to be used. In any event, these large costly bulbs burned out with the same or often greater frequency than ordinary household light bulbs. In some cases, smaller regular light bulbs were used inside a larger translucent globe to achieve savings in installation and replacement cost of the larger bulbs, but the desired visual effect was largely lost.

Initial efforts were made to produce an improve large bulb display by adapting the long life and low voltage and power advantages of the unbased miniature lights used in the displays of the aforementioned patent. A string of several miniature lamps was simply soldered between the foot terminal and the threaded metal side of a screw type base to be inserted through the tubular base opening into the spherical glass bulb. When lighted, at least some of these initial bulbs were noted to produce a very pleasing visual effect wherein multiple reflections of the miniature lamp could be seen at various locations within the bulb, thus giving the impression of a large number of smaller light sources within the bulb itself.

However, considerable problems were encountered in trying to make production quantities of the bulbs for commercial sale in that the multiple reflection effect varied considerably from bulb to bulb, and even those that produced a good quality effect in initial production testing for some reason did not produce the same effects after shipment and installation for customers. Analysis of the situation revealed that the best effects were achieved when all of the lamps were disposed at random locations within the bulb displaced substantially both from the central bulb axis and the interior reflecting surfaces. Apparently, for a lamp near the center, the image is focused back on or near the lamp itself to be obscured by its greater brightness; whereas a lamp next to the inner surface does not produce a separately discernable image on the adjacent surface. On the other hand, lamps with sufficient displacement from both the center and the inner bulb surface produce two distinct images at the opposite surfaces to be seen as multiple reflection from different areas of the bulb.

With this analysis of the problem, finding a practical solution presented other difficulties. Obviously the lamp string could not be formed in the desired configuration beforehand since it had to be bent together to fit through the narrow base opening in the bulb. Tedious efforts to rearrange the lamp string within the bulb using a thin probe made production and labor costs prohibitive, and even then, it was found that the flexible wire leads between the unbased lamps did not have sufficient rigidity to maintain the string in place. In many instances, jarring of the lamps in shipment or installation would cause gradual bending of the lamp leads until most of the lamps lay against the inner surface of the bulb. Even in normal use, a softening of the wire leads from heating or possibly metal fatique probably caused gradual bending of the string so that the lights gradually came to rest against the inner surfaces. Thus, while this initial design was sold to some enthusiastic customers for demonstration purposes, the high production cost, careful handling and frequent replacement prohibited development of these as a commercially feasible product.

BRIEF SUMMARY OF THE INVENTION

In accordance with the invention as previously noted in the foregoing Abstract, a number of unbased miniature lamps, preferably six, are connected in series by welding or soldering the ends of the flexible wire leads together. One end of the string is soldered or welded to the end of a rigid center wire that extends upwardly from the central foot terminal of a lamp base, preferably of the screw type, that fits over the tubular base opening of a round transparent bulb.

The lamp string is considerably longer than the rigid wire so that it can be bent with a double fold in the form of a flattened S against the rigid wire while the unattached free end of the string is held against the outer surface of the metal threaded portion of the base. Thus, the rigid wire and folded lamp string can be inserted together through the narrow tubular base opening in the bulb so that the far end of the rigid wire, where the lamp string is attached, is placed near the opposite end of the bulb along or near the central axis. The free end of the lamp string is then held in place against the outer surface of the bulb near the base, while the base is rotated to twist the upper end of the lamp string. With a few turns, the twisting force applied to the flexible wire leads causes the folded lamp string to open out to distribute the lamps within the bulb at random positions that are displaced both from the central axis and from the inner concave reflecting surfaces of the bulb where one or more possible reflections could be masked by the brighter light from the lamp itself.

Also the twisting action places the expanded S-shaped folds of the lamp string in spring like tension between two remote points, thus imparting sufficient rigidity to the string to maintain the lamps in their set positions against jarring forces encountered during shipment, installation and use. Accordingly, the maximum visual impact of myriad reflections is preserved throughout the life of the lamp.

In the preferred embodiment, the unbased lamps are of the T-1 or "175" type available commercially at very low prices for use primarily in instrument panel illumination of small indicator displays such as red warning lights or small "power on" buttons. These lamps are normally rated at six volts and less than one watt, and have an extremely long normal operating life of more than 10,000 hours. In most instances, these lamps as used in this invention may be operated at reduced power levels with only four volts thereby substantially reducing the power requirements and exponentially increasing the operating life to the point where the lamps might as a practical matter need never be replaced. With six of these miniature lamps, each bulb consumes less than two and one-half watts of power to permit a safe low voltage system of only twenty-four volts, while producing a decorative visual effect of much higher powered lamps.

DETAILED DESCRIPTION

Figure 1:
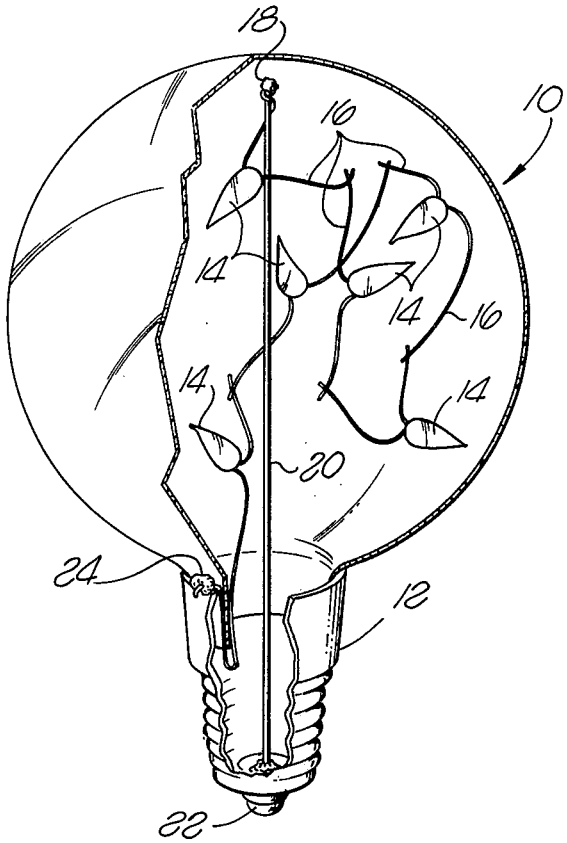
FIG. 1 is a perspective view of a low energy decorative light bulb in accordance with the invention; and, FIG. 2 is a perspective view illustration of a typical chandelier assembly employing the low energy decorative light bulb displays in accordance with the present invention.

Referring now to FIG. 1, a preferred embodiment of the low energy decorative light bulb in accordance with the invention has a spherical transparent bulb 10 with its tubular base opening mounted within a metal screw type base 12. Such transparent bulbs 10 are readily available in a variety of sizes from many sources, including most well stocked hardware and home supply retail outlets, and may even be plastic, although glass is generally preferred because its higher index of refraction gives greater reflectivity. For example, smaller versions of these bulbs may employ a two and a quarter inch diameter spherical glass mold produced by Corning Glass for distribution by many retail sources. A suitable screw type base would be that produced by General Electric under the designation GE-1003-02 that has a brass threaded portion.

A string of six unbased miniature lamps 14 contained within the bulb 10 is formed by welding the flexible wire leads 16 extending from the lamps end-to-end in series. The free lead at one end of the string is affixed by solder 18 to the upper end of a rigid center wire 20 that extends along the central vertical axis of the bulb 10 from the foot terminal 22 of the screw type base 12. The rigid center wire 20 may be a light gage hook-up wire preferably with lacquer or other insulative coating that melts or boils off with the heat applied during soldering or welding of electrical connections. The base end of the wire 20 is held in position by soldering to the foot terminal connection within the end of the screw type base 12. The lamp lead 16 at the other end of the string extends through the narrow tubular opening at the base end of the bulb and is brought out along the interior surface of the upper unthreaded portion of the base 12 to be connected by solder 24 to its outer edge.

The lamps 14 are all distributed within the bulb at locations that are substantially displaced outwardly from that vertical central axis of the bulb occupied by the rigid center wire 20 and from the inner reflective surfaces of the bulb 10 to maximize the discernable reflections. With this arrangement, the reflections seen by the viewer are produced from different locations on the bulb, each producing a different pattern of lights based on the angle from which the three dimensional grouping is being reflected. The concave reflective surfaces within the bulb reflect the light patterns with reduced size and a distortion of relative size and position based on the spacing of each light from the reflective surface and from its effective focal point. Thus, each of the numerous reflections presents a different pattern of lights that the viewer does not associate with the brighter pattern of lights produced by the actual lamps 14.

It is to be noted that, although a spherical bulb 10 is employed in the preferred embodiment shown herein, similar effects may be achieved with other rounded bulb or globe shapes, such as flame shaped Christmas tree bulbs, or even with special bulbs having polygonal facets. Also the bulb 10 may be a clear transparent glass, or certain effects are enhanced with lightly tinted colored glass bulbs, such as yellow or amber, or multiple colors for Christmas tree strings.

In assembling the decorative light bulb structure of the invention, the light string being much longer than the rigid center wire 20 is pressed against it with a double fold to produce a flattened S configuration along a middle section of the rigid wire 20 that allows the long string to be easily inserted through the narrow tubular base opening in the bulb 10. The wire lamp lead 16 at the free end of the string is held against the outer edge of the base 12 while the string is inserted into the bulb 10 until the upper unthreaded portion of the base 12 receives the narrow opening in the lower tubular base portion of the bulb 10. A suitable glue or cement, or preferably a hot melt plastic, applied between the outer surface of the tubular portion bulb opening and the inner surfaces of the upper unthreaded portion of the base 12 holds them together.

As the tubular base portion of the bulb is inserted into the upper end of the base 12, the wire lead at the free end of the string is pulled downwardly to open the folds radially outward. Then the protruding wire end is held stationary against the outer surface of the bulb 10 position while the base 12 is rotated. This relative rotation causes a twisting of the wire lead where it is attached by solder 18 to the upper end of the rigid center wire 20 thus applying tension to the folded string. As a result, the flat folds are spread tangentially to move each of the lamps 14 a bit further outwardly from the central axis of the bulb into positions between the wire 20 and the inner surfaces of the bulb 10 to achieve maximum reflective effect as previously described. After the proper amount of twisting has moved the lamps 14 into a desired configuration within the bulb 10, the free end of the wire lead 16 at the end of the string is released from the bulb and folded over to be affixed to the metal base 12 with solder 24. The twisting tension also acts on the somewhat rigid but flexible lead wires 16 to hold the entire string under spring like tension so that the bulbs retain their position against jarring forces encountered in shipment, installation and use. In the meantime, the cement, glue or melted plastic between the adjacent base portion of the bulb 10 and the base 12 sets or hardens to form a permanent bond affixing the two together.

Although the rigid wire 20 is illustrated extending straight from the base 12 along the central axis of the bulb 10, a comparable result might be achieved by using a curved wire or wires of other configurations that terminates substantially off axis to achieve the desired twisting of the folded string assembly. In the smaller spherical lamps, the axial wire placement helps to maintain the lamps away from the center of the bulb where their reflection could be masked, but in the larger bulbs, a curved or hooked wire that terminates off axis is usually more effective. Of course, with the larger bulbs, longer or even multiple lamp strings may be employed.

Figure 2:
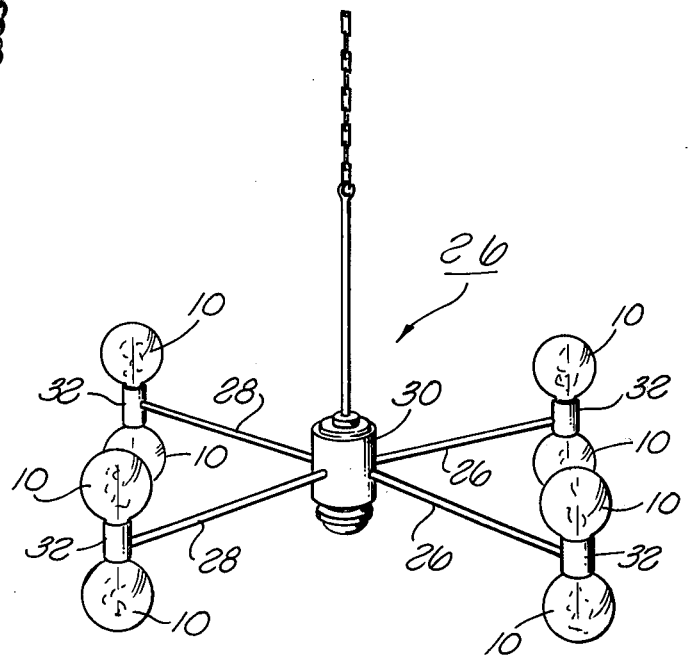

Referring now to FIG. 2, a simple chandelier structure 26 employing the spherical decorative light bulbs shown and described in conjunction with FIG. 1 has four radial arms 28 extending outward from a cylindrical hub 30 that hangs from a celing fixture (not shown). A low voltage transformer for supplying the low power requirements of the bulbs 10 may be placed within the hub 30 or preferably within the celing fixture. Wires extend out for connection to the female sockets located on opposite ends of the cylindrical fixture supported at the end of each of the radial arms 28 so that the decorative bulbs 10 extend in opposite directions. With the power of each bulb being limited to less than two and a half watts, the entire chandelier requires less than twenty watts to produce a very beautiful and startling visual effect. Another advantage of the system is that, whereas the bulbs themselves appear to produce much light from many different sources, the amount of light actually radiated outwardly from the bulbs is rather small. For indoor use, a popular chandelier design of the type shown in FIG. 2 with several banks of arms, one above the other, each with different radial dimensions, to produce a very beautiful visual effect without overwhelming a small room with light, such as would undoubtedly result from that many regular incandescent lights of this type.

Although a preferred embodiment of the invention and a typical decorative assembly employing such devices have been described herein for the purpose of illustrating the invention, it should be understood that various other arrangements and modifications other than those specifically described herein may be employed in other situations without departing from the spirit and scope of the invention as defined in the appended claims.

What is claimed is:

1. A decorative light bulb assembly comprising:

a transparent bulb with surrounding interior reflective surfaces and a narrow base opening at one end;

a base structure adapted to be permanently affixed to said bulb at said base opening and containing opposing base terminals for supplying electrical power from a lamp socket;

a lamp string consisting of a plurality of unbased miniature lamps with elongated flexible wire leads connected end-to-end in series, said lamp string having a length substantially longer than the distance between said base terminals and the opposite end of said bulb and having its two ends electrically coupled to the opposing base terminals with one end affixed to the base; and, twisting means for supporting a portion of said lamp string near said opposite end of said bulb at a point remote from the base for imparting a rotary spring-like tension that opens folds in said lamp string to distribute said lamps within said bulb at locations substantially displaced from the central axis and inner reflecting bulb surfaces, thereby producing myriad reflective images of said lamps within said bulb.

2. The decorative light bulb assembly of claim 1 wherein:

said base structure comprises a screw type base with a threaded metal outer terminal for receiving said narrow base opening of said transparent bulb and a central foot terminal; and, said one end of said lamp string is affixed to said threaded metal base portion.

3. The decorative light bulb assembly of claim 2 wherein:

said twisting means comprises a rigid conductive wire affixed at one end to said foot terminal and at its other end to the other end of said lamp string near said opposite end of said bulb.

4. The decorative light assembly of claim 1 wherein:

said lamp string is doubly folded for insertion through the narrow base opening of said bulb; and, said twisting means imparts a twisting force to one end of said lamp string to open said folds.

5. The decorative light bulb assembly of claim 4 wherein:

said twisting means comprises a rigid conductive wire having one end affixed to a base terminal at the center of said base structure and the other end electrically connected to the other end of said lamp, whereby the base structure is rotated relative to said bulb while said one end of the lamp string is held stationary against said bulb.

6. Th decorative light bulb assembly of claim 1 wherein:

said bulb is substantially spherical in shape with a narrow tubular base opening extending radially outward.

7. The decorative light assembly of claim 6 wherein:

said base structure comprises a screw type base having a threaded outer terminal for receiving the narrow tubular base opening of said bulb and for affixing said one end of said lamp string by soldering thereto, and a central foot terminal for affixing said twisting means; and, said twisting means comprises a rigid insulated wire having one end affixed to said foot terminal and the other end electrically coupled by soldering to the other end of said lamp relative to said bulb while the one end of said lamp string is held stationary against said bulb.

* * * * *